US007431568B2

(12) United States Patent
Brown et al.

(10) Patent No.: US 7,431,568 B2
(45) Date of Patent: Oct. 7, 2008

(54) DRAFT INDUCER HAVING A BACKWARD CURVED IMPELLER

(76) Inventors: Fred A. Brown, 55 Delaport Pl., Coronado, CA (US) 92118; Philip J. Bowen, 10448 Park Dale Ave., San Diego, CA (US) 02126

( * ) Notice: Subject to any disclaimer, the term of this patent is extended or adjusted under 35 U.S.C. 154(b) by 361 days.

(21) Appl. No.: 10/847,207

(22) Filed: May 17, 2004

(65) Prior Publication Data

US 2005/0255417 A1 Nov. 17, 2005

(51) Int. Cl.
*F04B 49/06* (2006.01)

(52) U.S. Cl. ..... 417/44.1; 122/13.01

(58) Field of Classification Search ..... 417/42, 417/44.1, 44.11; 122/14.1, 14.31, 13.01
See application file for complete search history.

(56) References Cited

U.S. PATENT DOCUMENTS

| | | | | |
|---|---|---|---|---|
| 4,295,606 | A | 10/1981 | Swenson | 237/12.1 |
| 4,768,947 | A * | 9/1988 | Adachi | 431/80 |
| 5,341,795 | A | 8/1994 | Chou et al. | 126/110 R |
| 5,347,958 | A | 9/1994 | Gordon, Jr. | 122/20 B |
| 5,352,099 | A | 10/1994 | Anstine et al. | 417/366 |
| 5,558,499 | A | 9/1996 | Kobayashi | 416/186 R |
| 5,832,986 | A | 11/1998 | Kenny et al. | 165/80.3 |
| 6,231,311 | B1 | 5/2001 | Gatley et al. | 417/53 |
| 6,398,512 | B2 | 6/2002 | Stewart | 417/53 |
| 6,450,874 | B2 | 9/2002 | Hoyez et al. | 454/16 |
| 6,508,627 | B2 | 1/2003 | Gerken et al. | 416/186 R |
| 6,602,058 | B1 * | 8/2003 | Stewart | 417/366 |
| 6,807,925 | B1 * | 10/2004 | Lesage | 122/14.1 |
| 2003/0034151 | A1 | 2/2003 | Lopatinsky et al. | 165/122 |

FOREIGN PATENT DOCUMENTS

| | | |
|---|---|---|
| BE | 822 316 A | 3/1975 |
| DE | 91 11 745 U1 | 12/1992 |
| DE | 44 40 495 A 1 | 5/1996 |
| EP | 0 762 051 A2 | 3/1997 |

* cited by examiner

*Primary Examiner*—William E Tapolcai

(57) ABSTRACT

A draft inducer is disclosed. The draft inducer includes an impeller having one or more backward curved blades. The impeller is coupled to a motor which is preferably a DC motor. The DC motor resides at the center of the impeller and is housed within the impeller structure. The draft inducer may be mounted on a hot water heater between the hot and cold water pipes such that the impeller spins about a vertical axis.

16 Claims, 7 Drawing Sheets

The Flow Rate has been achieved

The Flow Rate has been achieved

DRAFT INDUCER HAVING A BACKWARD CURVED IMPELLER

TECHNICAL FIELD AND BACKGROUND ART

The present invention relates to draft inducers for use with fossil fuel burning hot water heaters and also to other devices, such as furnaces and HVAC systems that may require a draft inducer. The following application will be described with respect to hot water heaters, but should not be seen as being limited as such to hot water heaters. Hot water heaters are only provided as an example.

Hot water heaters take in cold water and heat the water in a tank by burning a fuel such as gas or oil. The burning of the fuel produces an exhaust. In typical hot water heaters the tank is held inside of an outer structure so as to allow the heat to be transferred to the inner tank and to the water. The fumes that are produced by the burning of the fuel are extremely hot and need to be vented away from the outer structure of the hot water heater in order to prevent pressure buildup on the outer structure and the possibility that the structure will explode. The gasses rise up to the top of the outer structure and need to be safely exhausted.

In prior art systems, the hot gas produced by a hot water heater is coupled directly to metal piping for venting the hot gas to an outside location. Metal piping is rather expensive and draft inducers were developed in order to reduce the temperature of the hot gas, so that cheaper piping, such as PVC tubing could be used in place of the metal piping. Further, PVC piping allows routing of the exhaust in non-linear directions which cannot be performed with metal piping.

In a typical hot water heater, the hot gases produced by burning the fuel to heat the water are vented between the hot water outlet pipe and the cold water inlet pipes that are found on the top of a hot water heater. Therefore, draft inducers are typically mounted between the cold and hot water pipes on the top of a hot water heater. The distance between the two pipes is on the order of seven inches in a typical hot water heater. Because of the typical line frequency in the power lines of 50-60 Hz, AC motors cannot rotate above 3200-3400 RPM. As a result of the speed limitation of AC motors, in order to provide proper ventilation, the size of the prior art forward-curved blades of the impeller must be so large that the draft inducer cannot be mounted horizontally between the hot and cold water pipes of a hot water heater. Therefore, the draft inducer would necessarily have to be mounted in a vertical configuration, such that the impeller would spin about a horizontal axis with respect to gravity.

The distance between the hot and cold water pipes is not large enough to accommodate a draft inducer having a horizontally spinning impeller with forward curved blades and coupled to an AC motor. In addition to being aesthetically unpleasant, such large prior art draft inducers produce excessive noise.

AC motors and forward curved impeller blades were used by prior art systems because AC motors exhibit a flat torque/speed curve. As such, even if the torque drops, the speed of the motor remains nearly constant. This characteristic was viewed as desirable, since the impedance on the draft inducer from application to application varies. For example, the length of the exhaust pipe that the draft inducer is used to drive may vary from approximately 1 foot to lengths of 45 feet or more. As such, the draft inducer with an AC motor would be able to drive the gases through the exhaust piping regardless of the length of the exhaust pipe. However, this causes the hot water heater to operate inefficiently if the exhaust pipe has a short length, since more gas is pulled out of the hot water heater along with the accompanying heat. Thus there is less energy present to heat the hot water and the hot water heater must use additional energy to obtain the desired water temperature.

SUMMARY OF THE INVENTION

In a first embodiment of the invention there is provided a draft inducer having an impeller which resides within a housing. The impeller includes one or more backward curved blades and a central impeller structure. The impeller is coupled to a motor which is preferably a DC motor. The DC motor resides at the center of the impeller and is housed within the impeller structure. The impeller includes one or more openings for letting a fluid flow between the blades of the impeller.

The draft inducer includes at least a fluid inlet for a first fluid and a fluid outlet for a combination of a first fluid and a second fluid. In some embodiments, the draft inducer has multiple fluid inlets. The multiple fluid inlets meet at a mixing chamber within the housing of the draft inducer. The mixing allows the second fluid to flow into the chamber and to mix with the first fluid. In one embodiment, the first fluid is the hot gas of the hot water heater and the second fluid is the ambient air. The second fluid is drawn into the mixing chamber as the result of the impeller spinning. The inlet to the mixing chamber may be a slit in a plate which allows hot gas (first fluid) from a hot water heater to pass into the mixing chamber. The pressure that builds up on the inlet side of the plate from the heated hot gas forces the hot gas through the slit and into the lower pressured mixing chamber. The impeller also assists in drawing the hot gas into the mixing chamber. The slit is sized so that the amount of ambient air brought into the mixing chamber by the spinning impeller is much greater than that of the hot gas, thus causing the temperature of the mixture to be much less than that of the hot gas.

The size of the hot gas inlet and the ambient air inlet are adjusted along with the power of the motor driving the impeller to produce compliant exhaust emissions and exhaust temperatures for a given length of exhaust pipe.

The draft inducer is sized so that it may reside between the cold water inlet pipe and the hot water outlet pipe on the top of a hot water heater. Further, the impeller is sized such that it is mounted horizontally and spins about a vertical axis.

In a further embodiment, a predetermined flow rate is maintained in a flow path between the hot water heater or other source to be ventilated and the outside environment. The flow path starts at the outlet of the source to be ventilated, pass through the draft inducer to an exhaust pipe which terminates with the outside environment. The draft inducer in this embodiment has a voltage powered motor. First a voltage is provided to the motor which causes the motor and impeller blades of the draft inducer to rotate. This causes the exhaust from the source to be ventilated to be drawn into the draft inducer and passed through to flow path to the outside environment. The revolutions of the motor are determined, preferably the RPMs. The RPM signal is provided to a processor which compares the RPM value to values in a look-up table. If the measured RPM value does not substantially match a value in the look-up table, the voltage provided to the motor is adjusted. The process is continued until the measured RPM value is equal to a value within the look-up table. The look-up table is composed of RPM values that are associated with different voltage/impedance pairs. For example, for a given PWM waveform (voltage) and a given impedance (length of ventilation piping) a single RPM value is provided in the look-up-table. In the embodiment as disclosed the motor is preferably a DC motor and further the impeller has backward curved blades.

If the measured RPM value exceeds a predetermined threshold, an alarm will be activated indicating that there is an occlusion in the flow path. If the measured RPM value is below a predetermined threshold, another alarm is activated to indicate that there is a leak in the flow path. Both an occlusion and a leak can be determined using the methodology disclosed with using either a pressure sensor or a vacuum switch.

The methodology described may be performed in conjunction with a processor, and certain steps may be performed by computer code which is on a computer readable medium that is provided to the processor.

BRIEF DESCRIPTION OF THE DRAWINGS

The foregoing features of the invention will be more readily understood by reference to the following detailed description, taken with reference to the accompanying drawings, in which.

DETAILED DESCRIPTION OF SPECIFIC EMBODIMENTS

Definitions. As used in this description and the accompanying claims, the following terms shall have the meanings indicated, unless the context otherwise requires: the term 'backward curved blade' is a term of art as understood by those in the art of impeller construction. The following application is described with respect to the use of a draft inducer with a hot water heater, however the draft inducers and methods may be used with other devices such as furnaces and HVAC (heating, ventilation, and air conditioning) systems.

Figure 1:
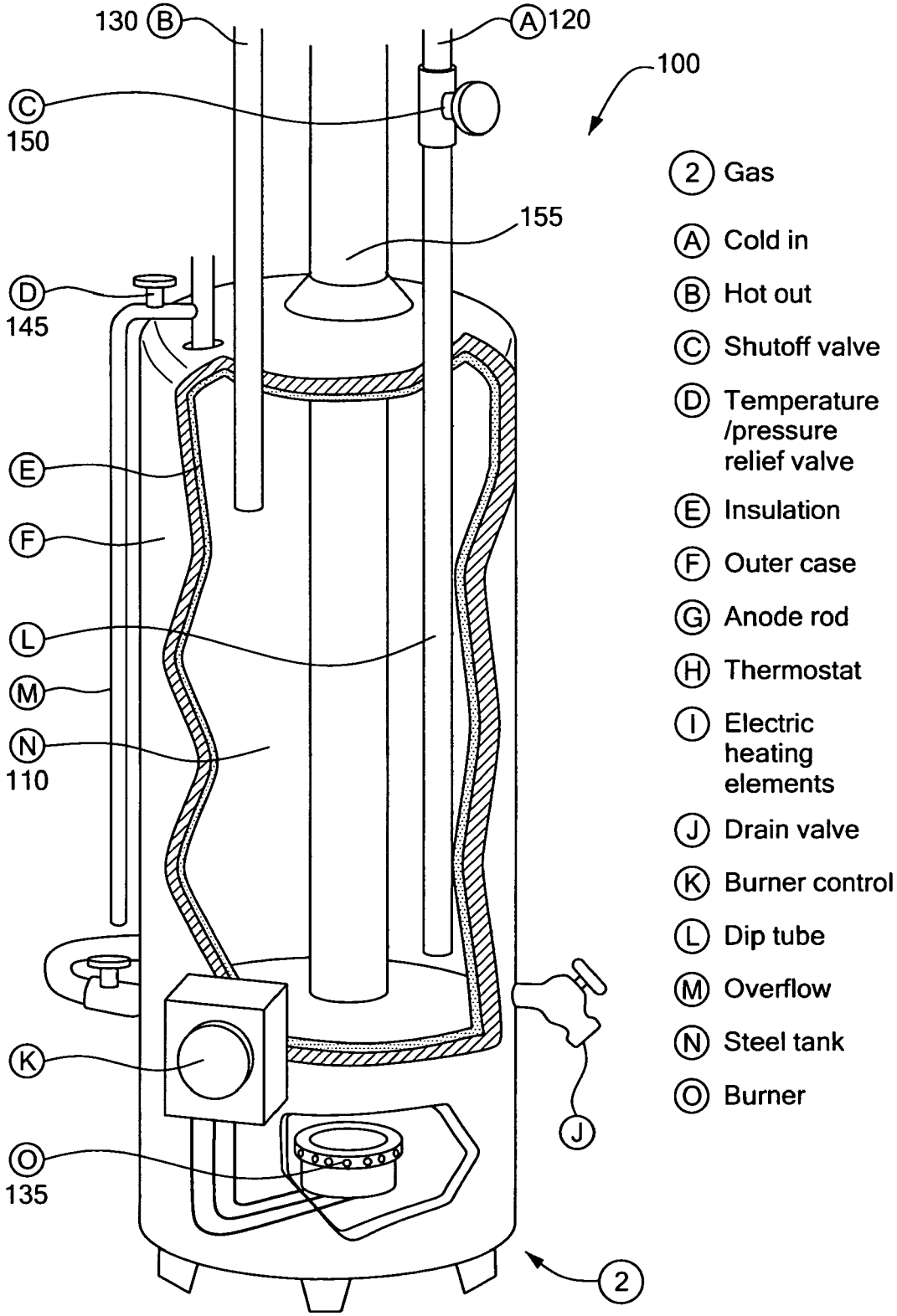
FIG. 1 is schematic drawing of a hot water heater.

FIG. 1 shows a typical hot water heater 100. The pictured hot water heater is a gas hot water heater. A hot water heater 100 includes a heavy inner steel tank 110 that holds the hot water. Cold water flows into the tank through a cold water pipe 120 that is generally located on the top of the steel tank as shown in the figure. The steel tank also has a hot water outlet pipe 130. The hot water heater contains a heating element 135 to heat the water and a thermostat to control the temperature of the water inside the tank. The tank also includes a pressure relief valve 145 in order to prevent the tank from exploding and a shutoff valve 150 that is coupled to the cold water inlet pipe. The approximate distance between the cold water inlet pipe 120 and the hot water outlet pipe 130 is on the order of several inches and usually approximately seven inches. On the top of the hot water heater 100 is a hot gas outlet 155 through which the fumes resulting from the burning fossil fuel are released. In prior art systems, the hot gas was vented using steel or cast iron pipes due to the extremely high temperature of the hot gas. In one embodiment of the invention, a draft inducer is mountable between the cold water inlet pipe and the hot water outlet pipe.

Figure 2:
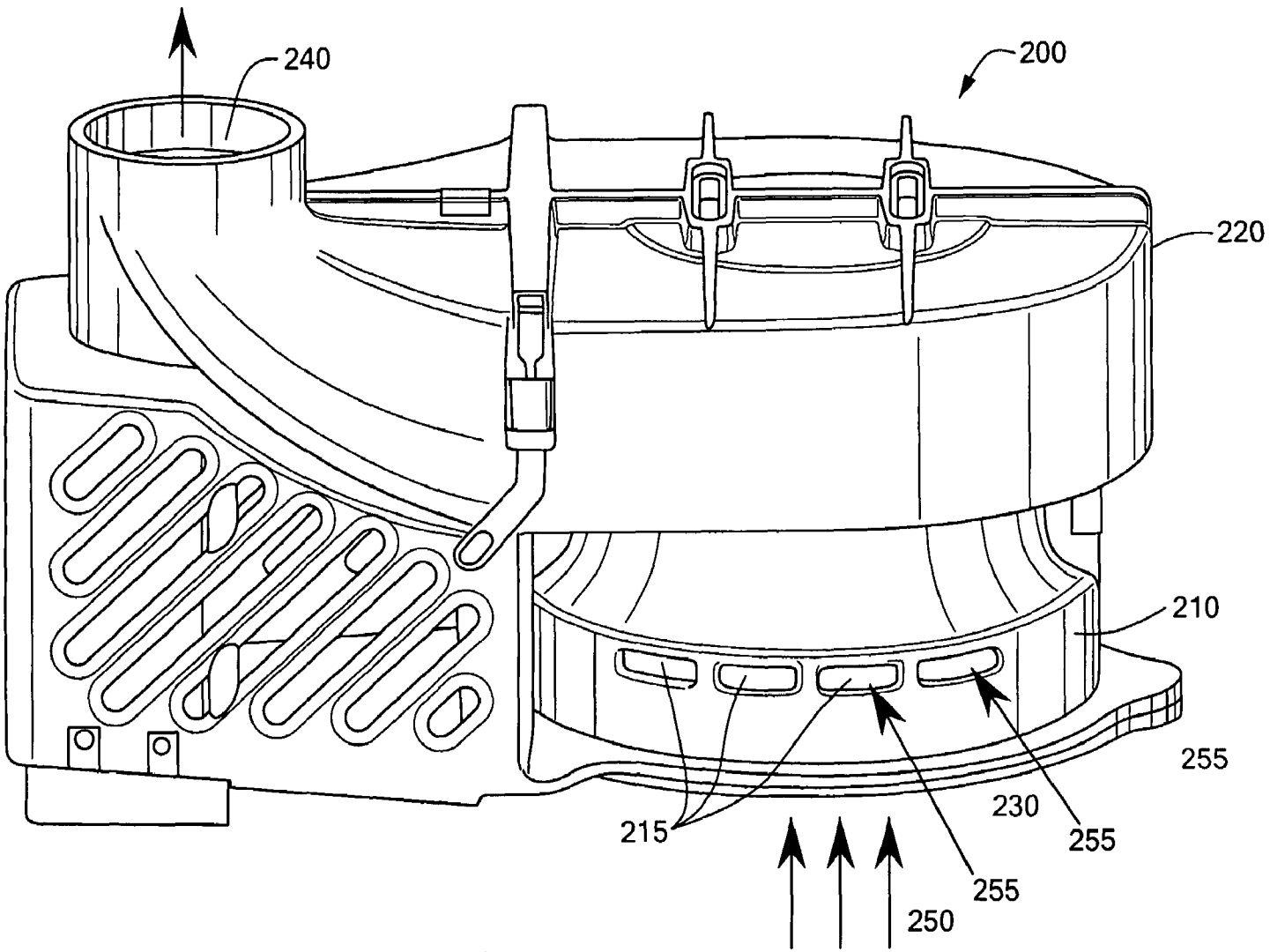
FIG. 2 is an outside view of a draft inducer according to one embodiment of the invention.

FIG. 2 is a side view of a draft inducer 200. A draft inducer 200 includes a mixing chamber 210, an impeller (not shown), a motor (not shown), and a housing 220. A fluid, such as air or a hot gas, flows in through an entrance 230 into the draft inducer housing and is redirected in a different direction by the impeller before it exits through an exit 240 in the housing 220. As the inlet fluid 250 flows through the housing, the inlet fluid is mixed with a cooling fluid 255, such as the ambient air, which reduces the temperature of the outlet fluid as compared to the inlet fluid. The mixing occurs in the mixing chamber 210. The mixing chamber includes one or more air inlets 215 that allow the ambient air into the housing. The pressure outside of the chamber is greater than the pressure inside of the chamber due to the spinning impeller (not shown). The impeller which is coupled to a direct current (DC) motor spins creating a pressure differential between the outside ambient air and the hot gas. In the preferred embodiment, the DC motor is brushless. The higher pressure and lower temperature ambient air brought into the mixing chamber mixes with the hot gas fumes. As a result of the mixing the ambient air with the hot gas, the ambient air cools the hot gas. Reducing the temperature of the hot gas permits lower cost piping to be used to vent the exiting fluid away from the hot water heater. Preferably the exiting fluid is vented outside of the room away from the hot water heater. By using a draft inducer, PVC piping may be used as opposed to metal piping. A cool pressurized PVC exhaust pipe can be routed in non-vertical directions making placement of the hot water heater easier with respect to the exhaust outlet. Further, the mixing of the ambient air with the hot gas also reduces the toxicity of the gas that is being exhausted so that the CO and $CO_2$ levels for the exhaust are within government guidelines or below a predetermined threshold.

In order to fit into the narrow spacing between the cold and hot water outlet pipes from the hot water heater, backwards curved impeller blades are used in conjunction with a DC motor for the draft inducer. The backward curved blades allow for higher volumes of air to be displaced when compared to forward curved blades. Since, the backward curved blades displace more air, the blades can be smaller than that of a forward curved blades and therefore the diameter of the impeller can be reduced. Further, backward curved blades add the additional benefit that they are quieter in operation as compared to the forward curved blades. As previously stated, a DC motor is coupled to the impeller. In comparison to an AC motor, a DC motor operates at higher speeds (RPMs) and is not as sensitive to line frequency. As a result, a DC motor's RPMs will not fluctuate with line noise. Because the motor operates at higher RPMs, the motor generates more force when compared to a similar AC motor, and therefore the DC motor can have a smaller profile as compared to an AC motor producing a similar amount of force. Because of this smaller profile, the DC motor can be housed within the impeller.

Figure 3:
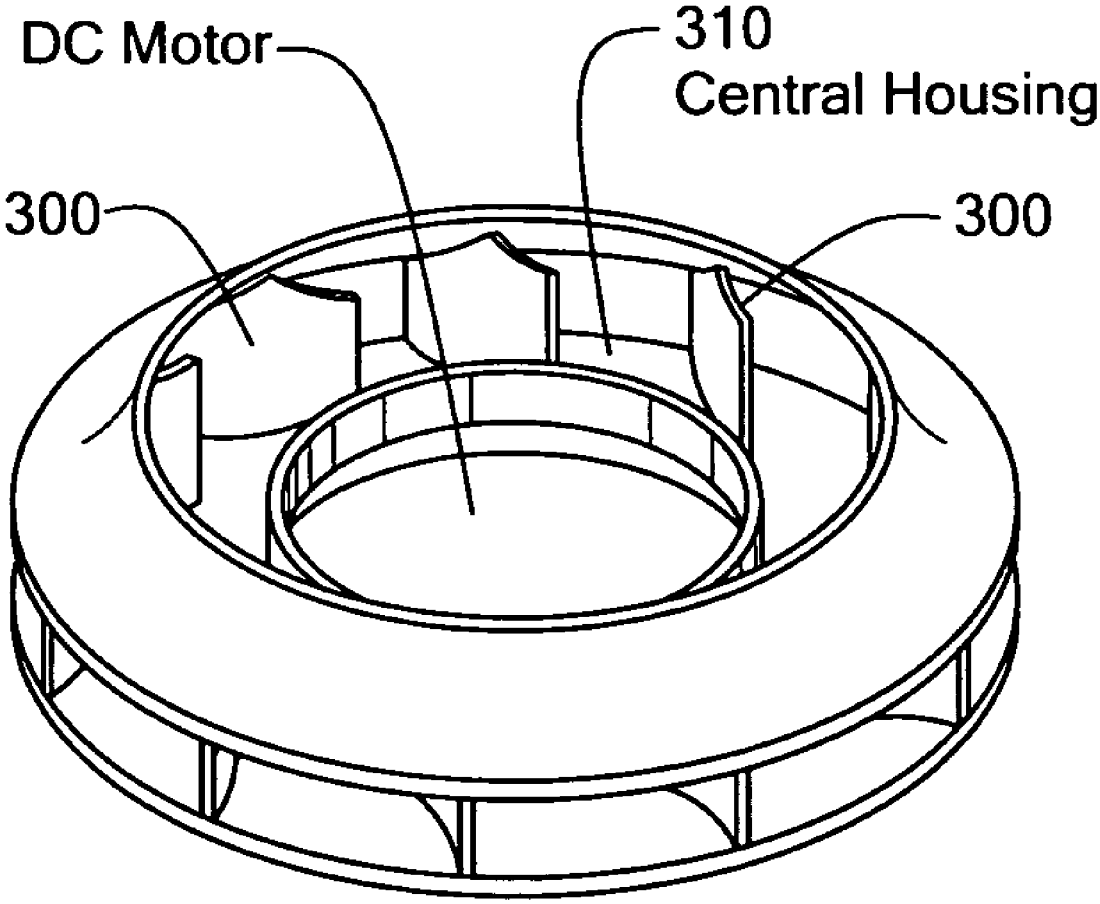
FIG. 3 is an isometric view of the impeller with backward curved blades.

As shown in FIG. 3 the blades 300 of the impeller are attached to a central housing 310 which is circular in shape. The circular housing 310 contains the DC motor (not shown) there within. By placing the DC motor within the housing 310, having backward curved blades 300 and having the DC motor spin at a high rate, the draft inducer can produce a similar pressure differential to that of a much larger frontward curved impeller/AC motor combination.

Figure 4:
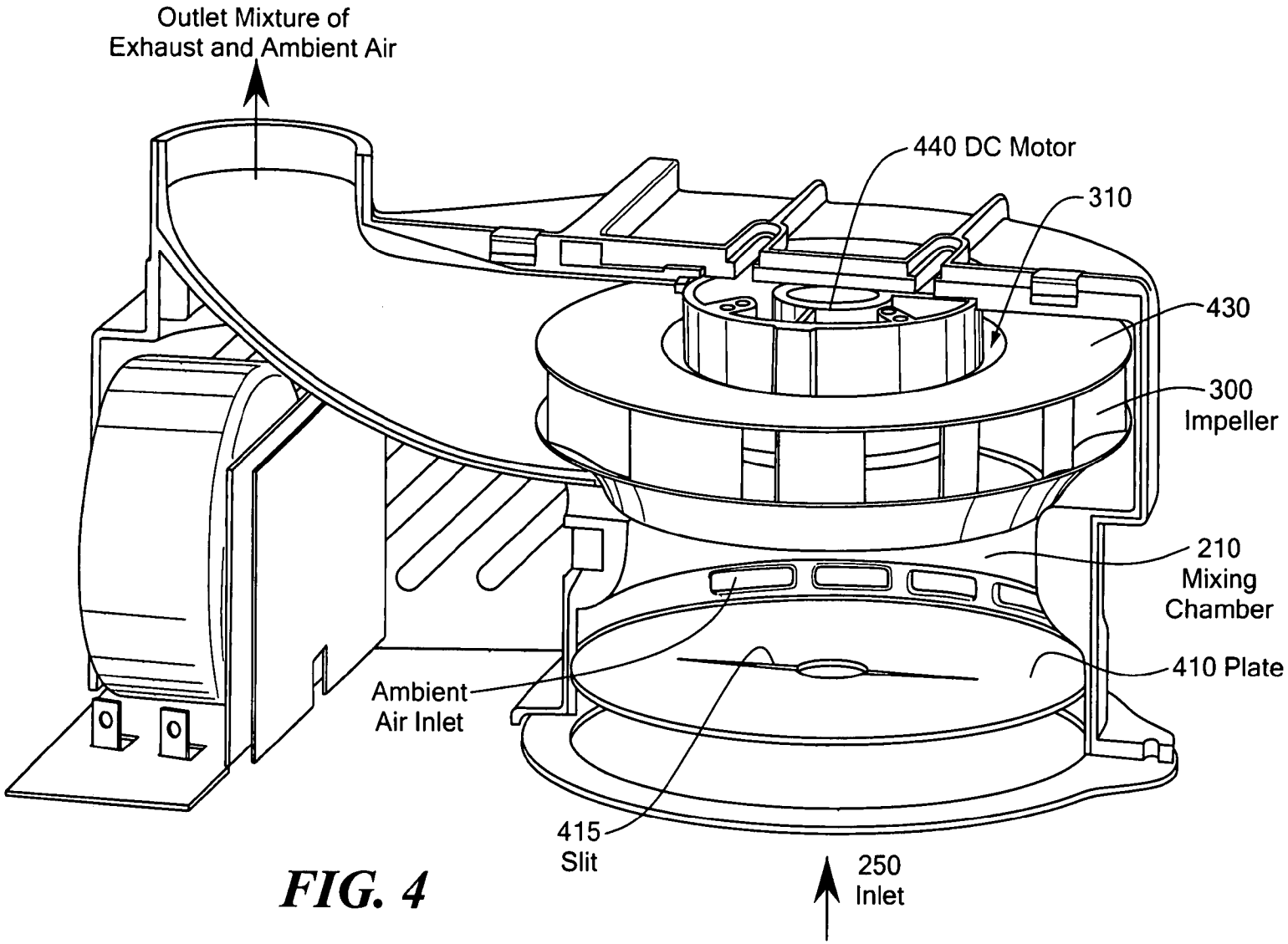
FIG. 4 is an isometric view of the draft inducer showing the impeller.

FIG. 4 is a cutaway view of the draft inducer of FIG. 2. A plate 410 having a slit 415 is provided at the entrance to the draft inducer. The slit 415 in the plate 410 allows the hot gas 250 from the hot water heater to flow into the mixing chamber 210. The slit provides a controlled amount of hot gas to be mixed with the ambient air. As a result, there is a great deal more ambient air as compared to the amount of hot gas, so that the temperature of the hot gas is substantially reduced and the hot gas will not damage a PVC pipe that is coupled to the exit of the draft inducer. FIG. 4 also shows the impeller 430 with the backwards curved blades 300 and the DC motor 440 mounted inside of the impeller housing 310. The size of the slit 415 and the ambient air inlets are adjusted, along with the power of the motor driving the impeller for a given length of exhaust pipe to control the exhaust temperature, the exhaust emissions and combustion within the hot water heater.

The DC motor 440 has a torque/speed curve that exhibits a fairly steep slope, such that, changes in load effects speed quickly. The DC motor is therefore sensitive to small changes to impedance. Examples of impedance include the length of the exhaust pipe that is attached to the draft inducer and also any blockage within the exhaust pipe.

Figure 4A:
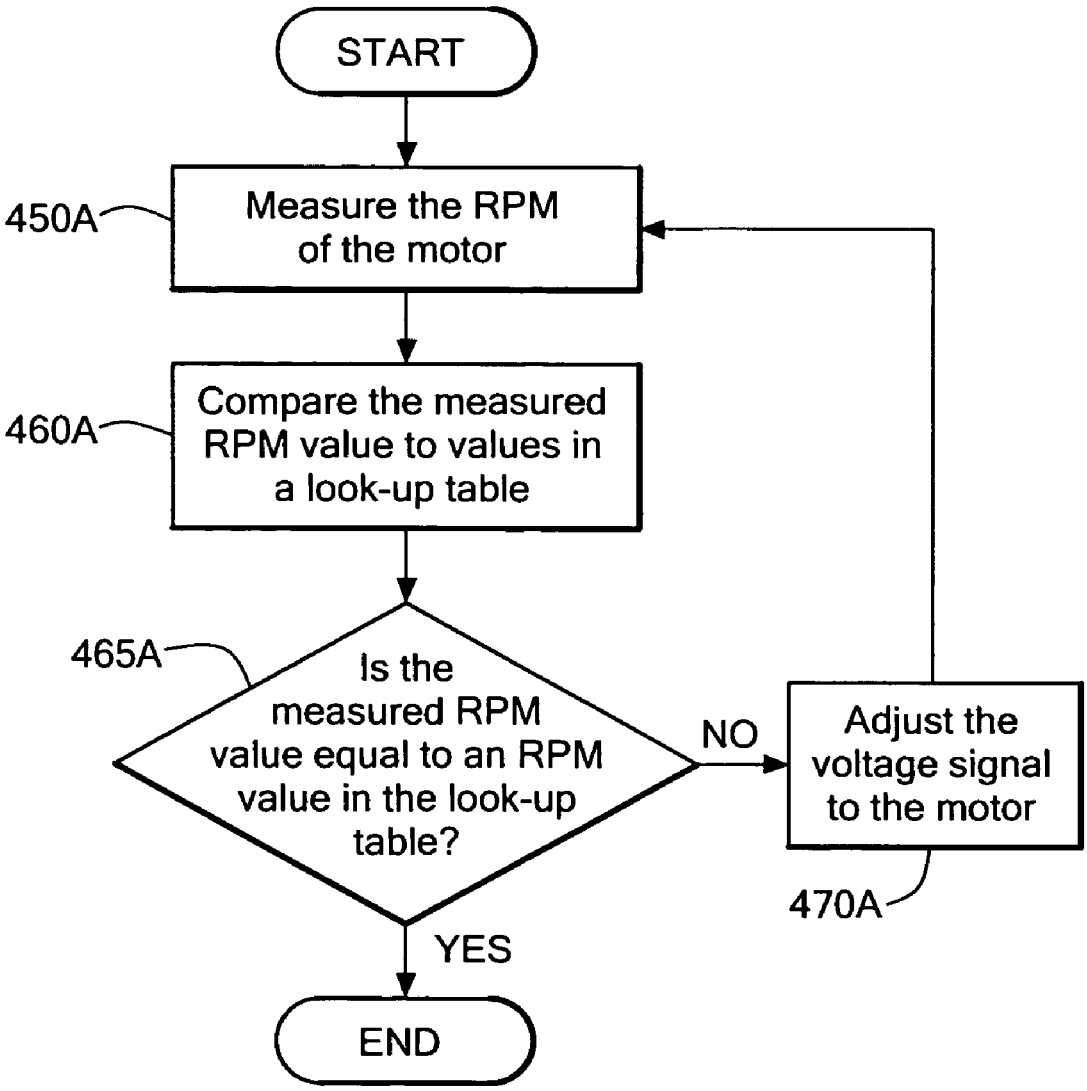
FIG. 4A is a flow chart of the steps used to obtain a desired flow rate.

FIG. 4*a* is a flowchart which shows the steps for obtaining a pre-determined flow rate. In one embodiment the constant flow rate is pre-determined to be approximately 27 CFM (cubic feet per minute) for efficient ventilation of a hot water heater. First, the DC motor of the draft inducer is provided with voltage. In one embodiment the voltage is provided in the form of a PWM signal. The initial PWM signal if for a pre-determined duty cycle which for example may be 60%. The RPM value of the rotor of the DC motor is determined using known techniques in the art, such as using a sensor or tachometer that is commonly part of a motor (450A). A look-up table in associated memory is accessed by a processor. The look-up table contains RPM values for each of a plurality of duty cycles and for each of a plurality of impedances. It should be understood by one of ordinary skill in the art that the look-up table contains the points at which the torque-speed curve of the DC motor intersects with the impedance curve for a given length of exhaust pipe. The processor then compares the measured RPM value with the values in the table (460A). The processor checks to see if any of the values within the look-up table matches the measured RPM value for the duty cycle (465A). If the measured value does not match any of the values in the look-up table, the voltage provided to the DC motor is adjusted such that the duty cycle of the PWM waveform will be either increased or decreased (470A). The processor identifies the value within the look-up table that is closest to the measured RPM. If the speed of the motor is higher than the expected value the duty cycle will be increased. If the speed of the motor is less than the closest expected value from the look-up table then the duty cycle will be decreased. If the measured value matches a value in the look-up table, the process stops and the PWM wave form is not adjusted further. When there is a match with the desired flow rate through the draft inducer. Based upon the matched RPM value, the processor can determine the length of pipe that is used in venting the draft inducer to the outside environment, since the RPM value is associated with a given impedance which is related to the length of the exhaust pipe. For each length of pipe there is only a single RPM value that will match for a given PWM signal. In certain embodiments, the processor will continue to measure the RPM values and make comparisons to compare the RPM values in case the impedance has changed. Through empirical experiments, it has been found that for a standard 2 to 3 inch pipe that is used for hot water heaters, that the ideal flow-rate is 27 CFM which maintains near ideal levels of CO and $CO_2$ for efficiency.

Using a DC motor and backwards curved blades allows the hot water heater to operate in a more efficient manner as compared to using a standard AC motor with forward curved blades in a draft inducer. As already stated, if the draft inducer can maintain a constant flow rate, while keeping the CO and $CO_2$ level at or near the minimum required by law, the draft inducer will allow the hot water heater to operate in an efficient manner. In this efficient state, the draft inducer removes gases from the hot water heater, but does not remove an excess amount of heat from the hot water heater. If the temperature of the gases drawn out of the hot water heater is too high, then too much heat is removed from the hot water heater and the hot water heater operates in an inefficient manner. As a result, more gas is required to be burned in order to heat the water to the desired temperature. This inefficiency will occur if the motor spins at a non-ideal rate causing the flow rate to be too high thereby drawing out more heat than is necessary from the hot water heater.

Figure 5A:
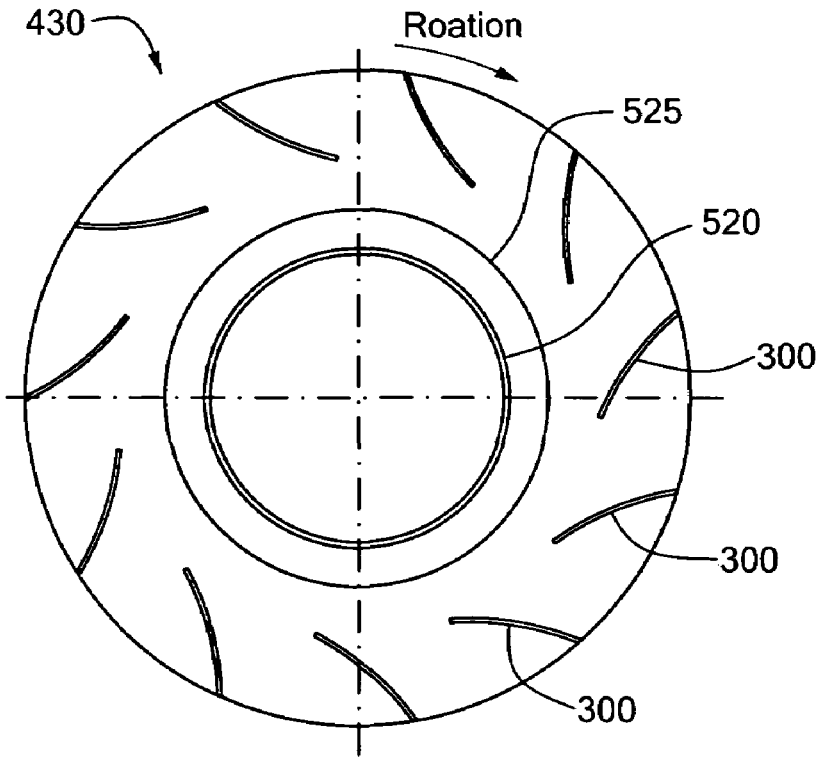
FIG. 5A is a top view of the impeller.
Figure 5B:
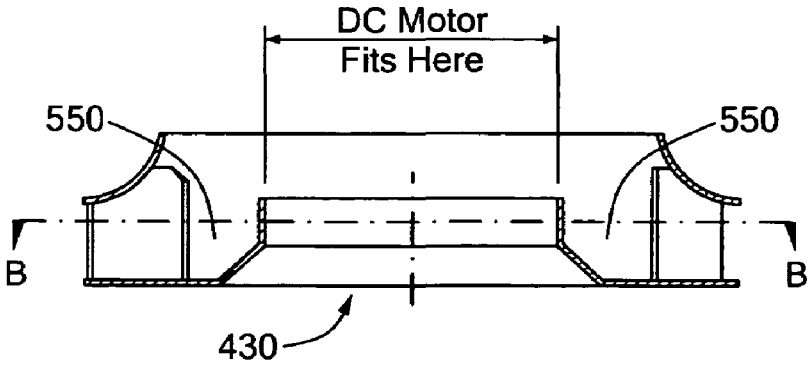
FIG. 5B is side view of the impeller structure.

FIG. 5A shows a schematic drawing of a top view of the impeller wheel 430 and the backward curved blades 300. As seen in FIG. 5A, there is a central ring 520. The DC motor fits inside of this ring and the motor provides the force for spinning the impeller. Between the central ring and the impeller blades there is a second circle 525. The space between the central ring and second circle is the opening through which the hot gas and ambient air mixture flows into the impeller and is redirected out at approximately 90 degrees by the impeller blades. FIG. 5B shows side view of the impeller 430 and the location for housing the DC motor. The air inlets 550 in the impeller are also shown. The air inlets 550 take air and the hot gas from the mixing chamber and provide the mixture into the impeller. The mixture is then passed onto the outlet which is formed in the housing. The outlet can then be coupled to any type of tubing, such as PVC tubing/piping since the temperature of the hot gas has been reduced by the introduction of the ambient air into the system.

Figure 6:
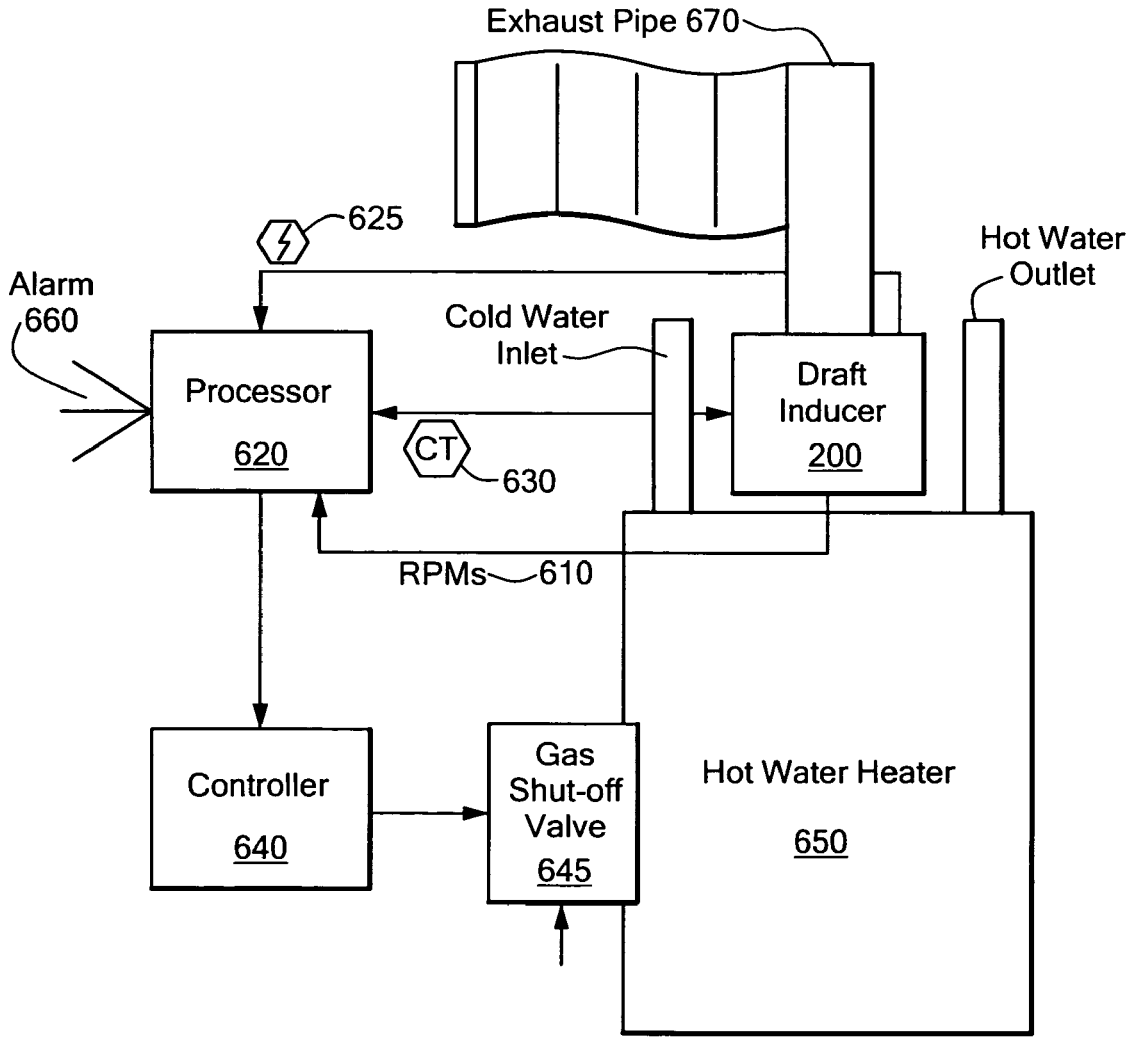
FIG. 6 is an alternative version of the draft inducer which includes a processor and a controller.

FIG. 6 shows another embodiment of the invention that may be used in conjunction with the method of FIG. 4A already discussed. The shaft of the motor of the draft inducer 200 is coupled to a sensor which can sense the revolutions per minute (RPM) of the rotor of the motor. The RPM signal 610 from the tachometer is provided to a processor 620. Additionally, the voltage 625 and current 630 drawn by the motor are provided to the processor 620. As discussed with respect to FIG. 4A, the RPM values are compared to values in a look-up table (LUT) which is in memory associated with the processor. The memory may be either random access memory or read only memory. If the measured RPM value does not match a value in the LUT and the voltage is increased (PWM waveform is varied) to the DC motor and the measured RPM increases above a threshold value the system will shut down. In such a situation, it is assumed that the exhaust pipe is blocked since the increase in voltage does not produce an increase in RPM as would be expected under normal operation. The threshold value could be determined by assuming an impedance value/exhaust pipe length that is greater than customarily used. If the RPM of the motor decrease below a threshold while the voltage is increased, the system can continue to operate, but an alarm will sound and it is assumed that there is a leak in the exhaust system. The processor 620 is electrically coupled to a controller 640 which controls the gas shut off valve 645 of the hot water heater 650. If the exhaust pipe is determined to be blocked, the processor 620 will cause the controller 640 to shut off the gas and the processor 620 will cause an alarm 650 to sound. The system may be provided with an audible alarm, a visual alarm, or both. Similarly, there may be different types of alarms for different conditions, such as when the exhaust pipe is presumed blocked or when the exhaust pipe is assumed leaking so that a person hearing the alarm can distinguish between system conditions. In the presently described embodiment, the presence of an occlusion or of a leak is accomplished without the use of pressure or vacuum sensing switch.

Although various exemplary embodiments of the invention have been disclosed, it should be apparent to those skilled in the art that various changes and modifications can be made which will achieve some of the advantages of the invention without departing from the true scope of the invention. These and other obvious modifications are intended to be covered by the appended claims.

What is claimed is:

1. A method for adjusting flow through a draft inducer to a pre-determined flow rate, the draft inducer having a voltage powered motor, wherein the draft inducer is coupled to a source to be ventilated and also coupled to an exhaust pipe of unknown length, the method comprising:

providing a voltage to the motor;

measuring the revolutions per time period of the motor;

comparing the measured revolutions per time period with a revolutions per time period value associated with the voltage in a look-up table, wherein the look-up table contains a plurality of voltage values, each having an associated revolutions per time period value to achieve the predetermined flow rate; and if the measured revolutions per time period do not substantially match the associated revolutions per time period value in the look-up table, iteratively adjusting the voltage provided to the motor to another voltage value in the look-up table until the measured revolutions per time period substantially match the revolutions per time period value associated with the voltage provided.

2. The method according to claim 1, wherein iteratively adjusting the voltage further comprises:

adjusting the voltage to a larger voltage value in the look-up table if the measured revolutions per time period of the motor are greater than the associated value in the look-up table; and adjusting the voltage to a smaller voltage value in the look-up table if the measured revolutions per time period of the motor are less than the associated value in the look-up table.

3. The method according to claim 1, wherein the motor is a direct current motor.

4. The method according to claim 3, wherein the source to be ventilated is a hot water heater.

5. The method according to claim 1, wherein the exhaust pipe has a fixed diameter.

6. The method according to claim 1, wherein the draft inducer includes an impeller with backward curved blades.

7. The method according to claim 1, wherein the look-up table contains a revolution-per-time-period value for a plurality of voltage and impedance pairs.

8. A method for determining if an occlusion is present in a flow path, wherein the flow path includes a draft inducer having a voltage powered motor coupled to a source to be ventilated and also coupled to an exhaust pipe, the method comprising:

providing a voltage to the motor of the draft inducer;

measuring the revolutions per time period of the motor;

comparing the measured revolutions per time period with a revolutions per time period value associated with the voltage in a look-up table, wherein the look-up table contains a plurality of voltage values, each having an associated revolutions per time period value to achieve the predetermined flow rate;

if the measured revolutions per time period do not substantially match the associated revolutions per time period value in the look-up table, iteratively adjusting the voltage provided to the motor to another voltage value in the look-up table; and activating an alarm if the revolutions-per-time period for the motor exceeds a predetermined threshold value.

9. The method according to claim 8, wherein the measuring of the revolutions per time period is determined without the use of a pressure sensor or vacuum sensing switch.

10. A method for determining if a leak is present in a flow path, wherein the flow path includes a draft inducer having a voltage powered motor coupled to a source to be ventilated and also coupled to an exhaust pipe, the method comprising:

providing a voltage to the motor of the draft inducer;

measuring the revolutions per time period of the motor;

comparing the measured revolutions per time period with a revolutions per time period value associated with the voltage in a look-up table, wherein the look-up table contains a plurality of voltage values, each having an associated revolutions per time period value to achieve the predetermined flow rate;

if the measured revolutions per time period do not substantially match the associated revolutions per time period value in the look-up table, iteratively adjusting the voltage provided to the motor to another voltage value in the look-up table; and activating an alarm if the revolutions-per-time period for the motor falls below a predetermined threshold value.

11. The method according to claim 10, wherein the measuring of the revolutions per time period is determined without the use of a pressure sensor or vacuum sensing switch.

12. A computer program product containing computer code on a computer readable medium for adjusting the flow to a pre-determined flow rate in a draft inducer having a voltage powered motor, wherein the draft inducer is coupled to a source to be ventilated and also coupled to an exhaust pipe of unknown length, the method comprising:

computer code for outputting a voltage to the motor;

computer code for receiving a measured the revolutions per time period of the motor;

computer code for comparing the measured revolutions per time period with a revolutions per time period value associated with the voltage in a look-up table, wherein the look-up table contains a plurality of voltage values, each having an associated revolutions per time period value to achieve the predetermined flow rate; and computer code for, if the measured revolutions per time period do not substantially match the associated revolutions per time period value in the look-up table, iteratively outputting to the motor a voltage having a new voltage value from the look-up table until the measured revolutions per time period substantially match the revolutions per time period value associated with the voltage provided.

13. The computer program product according to claim 12, wherein the computer code for iteratively outputting the voltage further comprises:

computer code for automatically outputting a voltage to the motor having a larger voltage value from the look-up table if the measured revolutions per time period of the motor are greater than the associated value in the look-up table; and computer code for outputting a voltage to the motor having a smaller voltage value from the look-up table if the measured revolutions per time period of the motor are less than the associated value in the look-up table.

14. The computer program product according to claim 12, wherein the look-up table contains a revolution-per-time-period value for a plurality of voltage and impedance pairs.

15. A computer program product containing computer code on a computer readable medium for determining if an occlusion is present in a flow path, wherein the flow path includes a draft inducer having a voltage powered motor coupled to a source to be ventilated and also coupled to an exhaust pipe, the computer code comprising:

computer code for outputting a voltage to the motor;

computer code for receiving a measured the revolutions per time period of the motor;

computer code for comparing the measured revolutions per time period with a revolutions per time period value associated with the voltage in a look-up table, wherein the look-up table contains a plurality of voltage values, each having an associated revolutions per time period value to achieve the predetermined flow rate;

computer code for, if the measured revolutions per time period do not substantially match the associated revolutions per time period value in the look-up table, iteratively outputting to the motor a voltage having a new voltage value from the look-up table; and computer code for activating an alarm if the revolutions-per-time period for the motor exceeds a predetermined threshold value.

16. A computer program product containing computer code on a computer readable medium for determining if a leak is present in a flow path, wherein the flow path includes a draft inducer having a voltage powered motor coupled to a source to be ventilated and also coupled to an exhaust pipe, the computer code comprising:

computer code for outputting a voltage to the motor;

computer code for receiving a measured the revolutions per time period of the motor;

computer code for comparing the measured revolutions per time period with a revolutions per time period value associated with the voltage in a look-up table, wherein the look-up table contains a plurality of voltage values, each having an associated revolutions per time period value to achieve the predetermined flow rate;

computer code for, if the measured revolutions per time period do not substantially match the associated revolutions per time period value in the look-up table, iteratively outputting to the motor a voltage having a new voltage value from the look-up table; and computer code for activating an alarm if the revolutions-per-time period for the motor falls below a predetermined threshold value.

* * * * *